US010071751B2

(12) United States Patent
Yu et al.

(10) Patent No.: US 10,071,751 B2
(45) Date of Patent: Sep. 11, 2018

(54) MOUNTING STRUCTURE FOR EQUIPMENT COMPARTMENT BOTTOM PLATE

(71) Applicant: CRRC QINGDAO SIFANG CO., LTD., Qingdao, Shandong (CN)

(72) Inventors: Wenmin Yu, Shandong (CN); Zhaohua Wang, Shandong (CN); Shuhai Li, Shandong (CN); Yonglin Shan, Shandong (CN); Zhicheng Guo, Shandong (CN); Aiqin Tian, Shandong (CN); Guizhen Yan, Shandong (CN); Lijun Ma, Shandong (CN); Sansan Ding, Shandong (CN); Jianying Liang, Shandong (CN)

(73) Assignee: CRRC QINGDAO SIFANG CO., LTD., Qingdao, Shandong (CN)

( * ) Notice: Subject to any disclaimer, the term of this patent is extended or adjusted under 35 U.S.C. 154(b) by 170 days.

(21) Appl. No.: 15/112,978

(22) PCT Filed: Nov. 16, 2015

(86) PCT No.: PCT/CN2015/094663
§ 371 (c)(1),
(2) Date: Jul. 20, 2016

(87) PCT Pub. No.: WO2016/179994
PCT Pub. Date: Nov. 17, 2016

(65) Prior Publication Data

US 2017/0190338 A1 Jul. 6, 2017

(30) Foreign Application Priority Data

May 12, 2015 (CN) ..... 2015 1 0240207
May 12, 2015 (CN) ..... 2015 2 0304173 U

(51) Int. Cl.
*B61D 17/04* (2006.01)
*B61F 1/08* (2006.01)
*B61F 19/00* (2006.01)

(52) U.S. Cl.
CPC ..... *B61D 17/043* (2013.01); *B61D 17/041* (2013.01); *B61F 1/08* (2013.01); *B61F 19/00* (2013.01); *H05K 999/99* (2013.01)

(58) Field of Classification Search
CPC .... B61D 17/041; B61D 17/043; B61D 17/00; B61D 17/10; B61D 49/00; B61D 17/04; B61F 1/08
(Continued)

(56) References Cited

FOREIGN PATENT DOCUMENTS

CN 201400177 Y 2/2010
CN 103847755 A 6/2014
(Continued)

OTHER PUBLICATIONS

Summary of the First Office Action for CN201510240207.0, dated Nov. 15, 2016.
(Continued)

*Primary Examiner* — Mark T Le
(74) *Attorney, Agent, or Firm* — U.S. Fairsky LLP; Yue (Robert) Xu

(57) ABSTRACT

A mounting structure for equipment compartment bottom plate is provided. The bottom plate is detachably connected to a skeleton boundary beam of the equipment compartment. A sliding rail is fixedly connected to a side of the bottom plate where the bottom plate is lap-jointed to a skeleton lateral beam of the equipment compartment. One of the sliding rail and the skeleton lateral beam is provided with a recess and the other is provided with a protrusion engaged with the recess. In the mounting structure, the connection of the bottom plate and the skeleton lateral beam is achieved by
(Continued)

the engagement of the recess and the protrusion. Therefore, connecting pieces for connecting the bottom plate and the skeleton lateral beam are removed and the number of the connecting pieces is significantly reduced.

11 Claims, 4 Drawing Sheets

(58) Field of Classification Search
USPC ..... 105/422
See application file for complete search history.

(56) References Cited

FOREIGN PATENT DOCUMENTS

| | | | |
|---|---|---|---|
| CN | 104015744 | A | 9/2014 |
| CN | 204110043 | U | 1/2015 |
| CN | 104527676 | A | 4/2015 |
| CN | 104843022 | A | 8/2015 |
| CN | 204605804 | U | 9/2015 |
| GB | 361425 | * | 11/1931 |
| JP | H0292769 | A | 4/1990 |
| JP | 2005053306 | A | 3/2005 |
| JP | 2013028291 | A | 2/2013 |

OTHER PUBLICATIONS

International Search Report for PCT/CN2015/094663 , dated Feb. 17, 2016, ISA/CN.

* cited by examiner

MOUNTING STRUCTURE FOR EQUIPMENT COMPARTMENT BOTTOM PLATE

This application is a National Phase entry of PCT Application No. PCT/CN2015/094663, filed Nov. 16, 2015, which claims the benefits of priorities to Chinese patent application No. 201510240207.0, titled "MOUNTING STRUCTURE FOR EQUIPMENT COMPARTMENT BOTTOM PLATE", filed with the Chinese State Intellectual Property Office on May 12, 2015 and Chinese patent application No. 201520304173.2, titled "MOUNTING STRUCTURE FOR EQUIPMENT COMPARTMENT BOTTOM PLATE", filed with the Chinese State Intellectual Property Office on May 12, 2015, the entire disclosures of which are incorporated herein by reference.

FIELD

This application relates to the technical field of rail vehicles, and particularly to a mounting structure for an equipment compartment bottom plate.

BACKGROUND

For saving an interior space of a railway vehicle and facilitating the mounting and layout of pipes and lines of an equipment, related vehicle equipments of a conventional rail vehicle, such as an urban light rail, a passenger train and multiple units, etc., are generally arranged below an underframe of a vehicle body together, thus a lower equipment compartment is formed.

When the rail vehicle travels at a high speed, a strong air pressure pulse may be generated and thus small stones or other objects under the vehicle and near the rail would be involved in. To avoid these objects hitting the lower equipment arranged in the equipment compartment and ensure a safe operation of the vehicle, a bottom plate is usually mounted at a bottom of the equipment compartment to seal the equipment compartment.

Referring to FIG. 1, FIG. 1 is a schematic view of a mounting structure for a conventional equipment compartment bottom plate.

As shown in the Figure, a conventional equipment compartment bottom plate 12 includes multiple plates (for example, three plates as shown in the figure) arranged in a lateral direction of the vehicle. The plates are lap-jointed and are sealed by sealing rubber strips. The plates and a skeleton 11 of the equipment compartment are fixedly connected by bolts 13. Specifically, the plates are fixed to an side beam of the skeleton 11 though the bolts 13 at either side of the vehicle body, and the plates are fixed to a lateral beam of the skeleton 11 by multiple sets of bolts 13 in a lateral direction of the vehicle body.

However, the mounting structure for the equipment compartment bottom plate has the following defects.

To ensure the bottom plate 12 to be reliably mounted, the multiple sets of bolts 13 should be provided to achieve the connection of the bottom plate 12 and the lateral beam of the skeleton 11. Therefore, connecting pieces are too many, causing an inconvenient mounting of the bottom plate 12 and an inconvenient maintenance. When the maintenance is performed, all the bolts 13 should be removed. After the maintenance is completed, all the bolts 13 have to be tightened again for fixing the bottom plate 12 and the skeleton 11 of the equipment compartment, which causes too much work in the maintenance process.

In view of this, the technical issue to be addressed by those skilled in the art presently is to improve the mounting structure for the equipment compartment bottom plate, which facilitates the mounting of the bottom plate and reduces the maintenance workload.

SUMMARY

An object of the present application is to provide a mounting structure for an equipment compartment bottom plate, which facilitates the mounting of the bottom plate and reduces the maintenance workload.

To address the above technical issue, the mounting structure of the equipment compartment bottom plate is provided according to the present application. The bottom plate is detachably connected to a skeleton boundary beam of the equipment compartment. A sliding rail is fixedly connected to a side of the bottom plate where the bottom plate is lap-jointed to a skeleton lateral beam of the equipment compartment.

One of the sliding rail and the skeleton lateral beam is provided with a recess, and the other is provided with a protrusion engaged with the recess.

In the mounting structure of the equipment compartment bottom plate, the sliding rail is fixedly provided on the bottom plate. The recess and the protrusion, which are engaged with each other, are provided respectively at the sliding rail and the skeleton lateral beam. When being mounted, the bottom plate is inclined upwardly from the bottom of the equipment compartment skeleton, which allows the sliding rail of the bottom plate and the skeleton lateral beam to be engaged with each other. In this way, the position of the bottom plate is limited in a length direction of a vehicle body. The bottom plate is fixed to the skeleton boundary beam by connecting pieces at either side of the vehicle body. Apparently, in this solution, the connection of the bottom plate and the skeleton lateral beam is achieved by the engagement of the recess and the protrusion. Compared with the background technology, connecting pieces for connecting the bottom plate and the skeleton lateral beam are removed. Apparently, the number of the connecting pieces is significantly reduced, which allows a convenient and fast mounting of the bottom plate. Further, since the number of the connecting pieces is significantly reduced, too much work to be done, due to too many connecting pieces to be removed, in the maintenance is avoided and thus the maintenance efficiency is improved.

Furthermore, the engagement of the bottom plate and the skeleton lateral beam is a pull-out type engagement, which improves the sealing of the bottom plate and skeleton lateral beam, and ensures the sealing performance of the equipment compartment.

Optionally, the mounting structure further includes a pressing block assembly provided on the skeleton lateral beam in order to limit the position of the bottom plate in a vertical direction.

Optionally, the pressing block assembly includes a transition base and a pressing block. The transition base is fixedly connected to the skeleton lateral beam, and the pressing block is connected to the transition base and presses the sliding rail onto the skeleton lateral beam tightly.

Optionally, the transition base is provided with a mounting hole for assembling the pressing block, and the mounting hole is an elliptical hole extending in a direction in parallel with the length direction of the vehicle body.

Optionally, the pressing block is a wedge-shaped pressing block.

Optionally, the pressing block assembly is arranged at the middle of the skeleton lateral beam.

Optionally, the bottom plate has a flanging portion provided at a side of the bottom plate where the bottom plate is connected to the skeleton boundary beam. The flanging portion fits against an outer side of the skeleton boundary beam. The flanging portion and the side beam are fixedly connected by bolts.

Optionally, a sealing piece is further provided between the flanging portion and the side beam of the skeleton boundary beam.

Optionally, the sliding rail is fixed to the bottom plate by welding.

Optionally, the bottom plate is made of aluminium alloy extrusions.

BRIEF DESCRIPTION OF THE DRAWINGS

For more clearly illustrating embodiments of the present application or technical solutions in the conventional technology, drawings referred to describe the embodiments or the conventional technology will be briefly described hereinafter. Apparently, the drawings in the following description are only some examples of the present application, and for those skilled in the art, other drawings may be obtained based on these drawings without any creative efforts.

Figure 1:
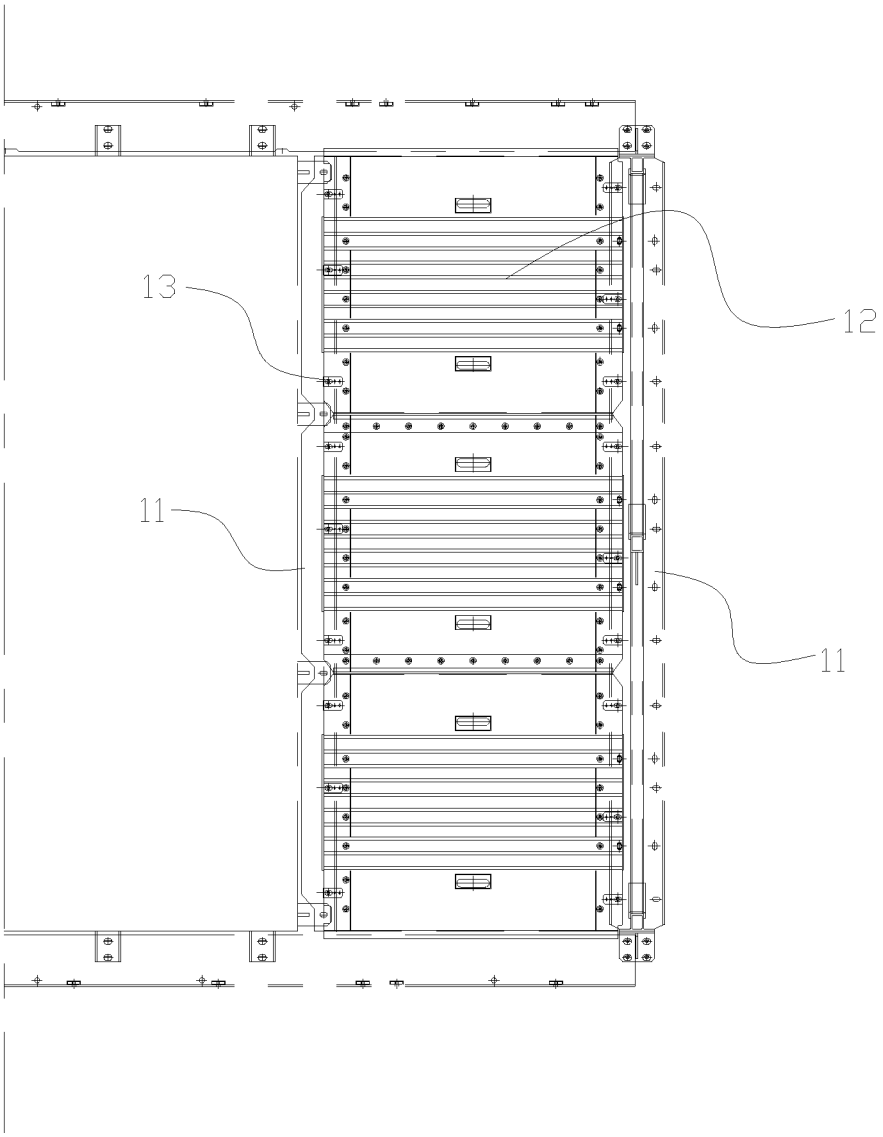
Fig. 1 Prior art
FIG. 1 is a schematic view of an existing mounting structure for a conventional equipment compartment bottom plate.

| Reference numerals in FIG. 1: | |
|---|---|
| 11 equipment compartment skeleton, | 12 bottom plate, |
| 13 bolt. | |

| Reference numerals in FIGS. 2 to 5: | |
|---|---|
| 21 skeleton boundary beam, | 211 side beam, |
| 22 skeleton lateral beam, | 221 protrusion, |
| 30 bottom plate, | 301 flanging portion, |
| 31 sliding rail, | 311 recess, |
| 32 sealing piece, | 33 sealing rubber strip, |
| 40 pressing block assembly, | 41 transition base, |
| 42 pressing block, | 43 fastening piece. |

DETAILED DESCRIPTION

To make the objects, technical solutions and advantages of the embodiments of the present application more clear, the technical solutions of the embodiments of the present application will be clearly and completely described hereinafter in conjunction with the drawings of the embodiments of the present application. Apparently, the embodiments described are some examples of the present application, and not all implementations. Other embodiments obtained by those skilled in the art based on the embodiments of the present application without any creative efforts all fall into the protection scope of the present application.

The core of the present application is to provide a mounting structure for an equipment compartment bottom plate, which facilitates the mounting of the bottom plate and reduces the maintenance workload.

The equipment compartment of a rail vehicle is arranged at a lower part of a vehicle body. The equipment compartment is an enclosed space, formed by an equipment compartment skeleton, a skirtboard and a bottom plate, for accommodating lower equipments, pipes, lines, etc.

The equipment compartment skeleton includes a skeleton boundary beam and a skeleton lateral beam. The bottom plate is connected to the equipment compartment skeleton for enclosing the bottom of the equipment compartment and protecting the lower equipments, pipes and lines placed in the equipment compartment from stone hitting and being frozen during the vehicle traveling.

It should be illustrated that the directional term "lateral direction" used herein refers to a width direction of the vehicle body. Correspondingly, the directional term "longitudinal direction" refers to a length direction of the vehicle body. Using these directional terms are only for the purpose of clearly and conveniently describing the technical solutions. It should be understood that these directional terms do not limit the protection scope claimed by the present application.

Figure 2:
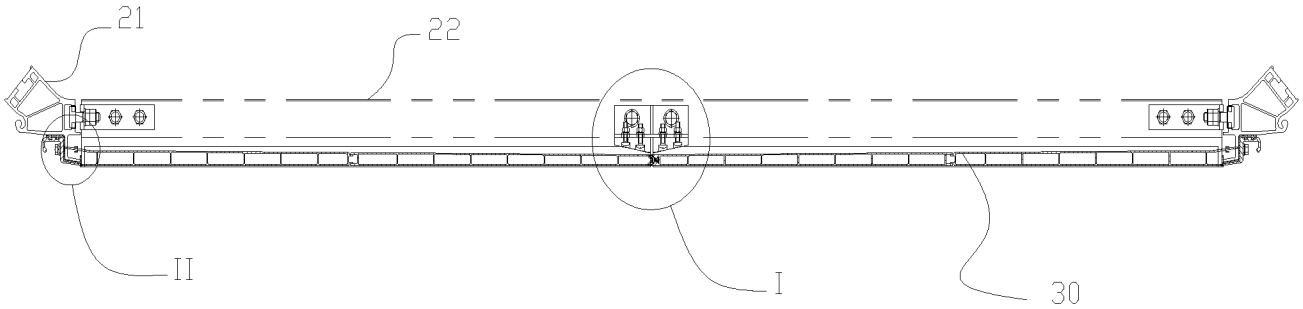
FIG. 2 is a lateral sectional view of a mounting structure for an equipment compartment bottom plate according to an embodiment.

Referring to FIG. 2, FIG. 2 is a lateral sectional view of a mounting structure for an equipment compartment bottom plate according to an embodiment.

In an embodiment, the mounting structure for the equipment compartment bottom plate according to the present application includes a mounting structure for mounting the bottom plate 30 and the skeleton boundary beam 21, and a mounting structure for mounting the bottom plate 30 and the skeleton lateral beam 22.

The bottom plate 30 is detachably connected to the skeleton boundary beam 21. The skeleton boundary beam 21 is located at either side of the vehicle body. When the bottom plate 30 and the skeleton boundary beam 21 are fixedly connected, the bottom plate 30 is limited in the lateral direction of the vehicle body.

Figure 3:
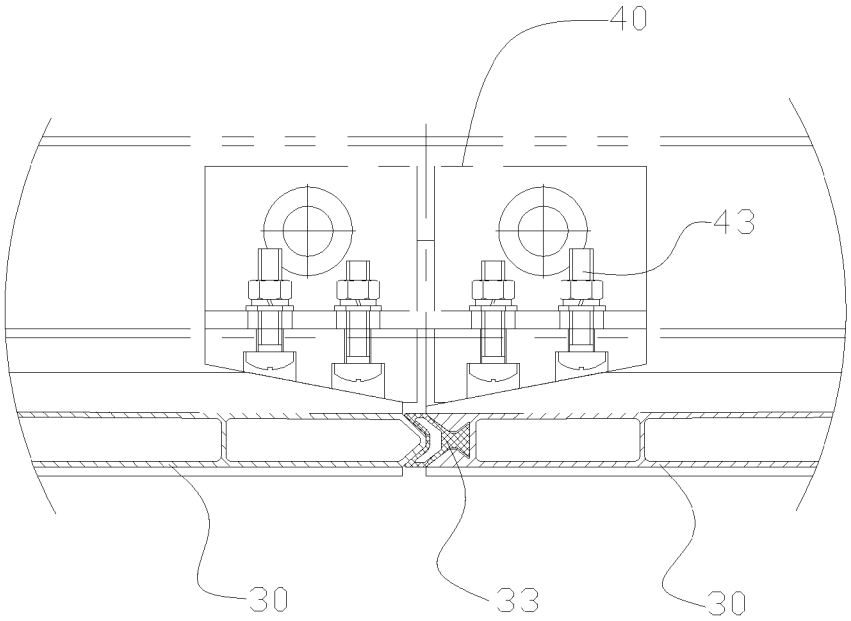
FIG. 3 is a partial enlarged view of part I shown in FIG. 2.
Figure 4:
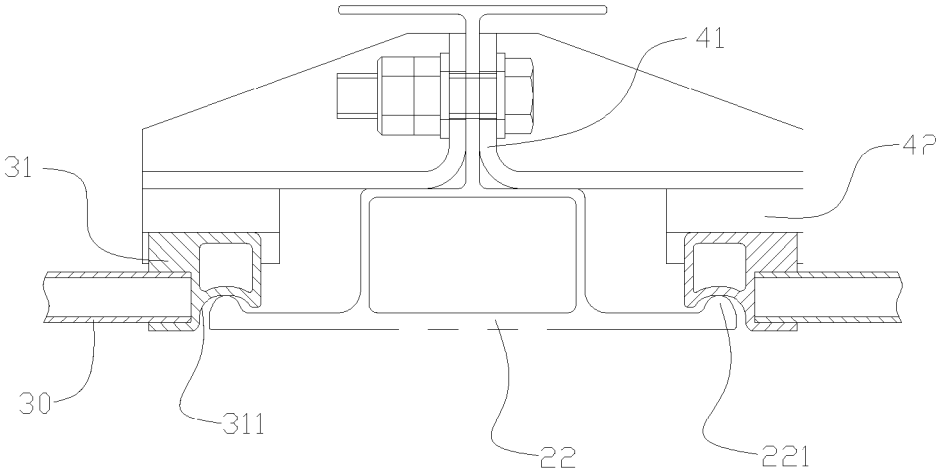
FIG. 4 is a left view of FIG. 3.

Referring to FIGS. 3 to 4, FIG. 3 is a partial enlarged view of part I shown in FIG. 2 and FIG. 4 is a left view of FIG. 3.

A sliding rail 31 is fixedly connected to a side of the bottom plate 30 where the bottom plate 30 is lap jointed to the skeleton lateral beam 22. This sliding rail 31 has a recess 311. The skeleton lateral beam 22 is provided with a protrusion 221 engaged with the recess 311, as shown in FIG. 4.

In a specific solution, the sliding rail 31 may be fixed to the bottom plate 30 by welding, which is convenient and reliable. Apparently, other fixing and connecting ways may also be feasible, for example, screw connection.

In this case, when the bottom plate 30 is mounted, the bottom plate 30 may be inclined upwardly from the bottom of the equipment compartment skeleton so as to allow the protrusion 221 on the skeleton lateral beam 22 to be engaged with the recess 311 of the sliding rail 31. In this way, the position of the bottom plate 30 is limited in the length direction (longitudinal direction) of the vehicle body. When the bottom plate 30 relative to the skeleton lateral beam 22 is limited, the bottom plate 30 is fixed to the skeleton boundary beam 21 by connecting pieces at either side of the vehicle body. In this way, the position of the bottom plate 30 is limited in the lateral direction of the vehicle body. When the bottom plate 30 needs to be dismounted, only the connection of the bottom plate 30 and the skeleton boundary beam 21 is to released, and the recess 311 of the sliding rail 31 and the protrusion 221 of the skeleton lateral beam 22 are disengaged by an external force, the bottom plate 30 may be removed out of the bottom of the equipment compartment skeleton.

From the above, it is known that the connection of the bottom plate 30 and the skeleton lateral beam 22 is achieved by the engagement of the recess 311 and the protrusion 221. Therefore, compared with the background technology, connecting pieces for connecting the bottom plate 30 and the skeleton lateral beam 22 are removed in this connection way. Apparently, the number of the connecting pieces is significantly reduced, which allows a convenient and fast mounting and dismounting of the bottom plate 30. Further, since the number of the connecting pieces is significantly reduced, the problem of too much work to be done, due to too many connecting pieces to be removed, in the maintenance is avoided and thus maintenance efficiency is improved.

Furthermore, the engagement of the recess 311 of the bottom plate 30 and the protrusion 221 of the skeleton lateral beam 22 is a pull-out type engagement, which improves the tightness of engagement of the bottom plate 30 and skeleton lateral beam 22 and ensures the sealing performance of the equipment compartment.

It may be understood that the sliding rail 31 being provided with a protrusion and the skeleton lateral beam 22 being provided with a recess may also be feasible in an actual arrangement. Similarly, the bottom plate 30 and the skeleton lateral beam 22 can also be connected conveniently.

Further, the mounting structure further includes a pressing block assembly 40 provided on the skeleton lateral beam 22. The pressing block assembly 40 can press the bottom plate 30 onto the skeleton lateral beam 22 tightly. In this way, the position of the bottom plate 30 is limited in a vertical direction (i.e., a height direction of the vehicle body), which improves the mounting reliability of the bottom plate 30.

In a specific solution, the pressing block assembly 40 includes a transition base 41 and a pressing block 42. The transition base 41 is fixedly connected to the skeleton lateral beam 22. The pressing block 42 is mounted to the transition base 41 and presses the sliding rail 31 onto the skeleton lateral beam 22 tightly. Thus the position of the bottom plate 30 is limited in the vertical direction.

Specifically, a pressing force applied on the sliding rail 31 exerted by the pressing block 42 may be achieved by a fastening piece 43. As shown in FIG. 3, the pressing block 42 is mounted to the transition base 41 by the fastening piece 43 and the fastening piece 43 is vertically arranged. The pressing force applied on the sliding rail 31 exerted by the pressing block 42 may be adjusted by adjusting the fastening force of the fastening piece 43.

In a specific solution, the mounting hole on the transition base 41 for assembling the pressing block 42 may be an elliptical hole, whose major axis is in the longitudinal direction. That is, the mounting hole is an elliptical hole extending in a direction parallel to the length direction of the vehicle body.

In this case, the fastening piece 43 may slide in the mounting hole in the longitudinal direction, which allows the pressing block 42 to be fastened at an appropriate position as desired and better press the bottom plate 30 tightly.

In a specific solution, the pressing block assembly 40 is arranged at the middle of the skeleton lateral beam 22 so as to uniformly distribute the pressing force applied on the bottom plate 30 over the bottom plate 30 and avoid the bottom plate 30 bending upwardly due to an non-uniform force.

Apparently, several sets of pressing block assemblies 40 may also be uniformly arranged at the skeleton lateral beam 22.

In a specific solution, the pressing block 42 of the pressing block assembly 40 may be of a wedge-shaped structure. Correspondingly, the face of the sliding rail 31 mated with the pressing block 42 is also of a wedge-shaped structure. In this way, the pressing of the pressing block 42 can be applied to the utmost and thus the position of the bottom plate 30 can be better limited in the vertical direction.

In the case that the pressing block assembly 40 is provided, the mounting of the bottom plate 30 is as follows. When the bottom plate 30 and the skeleton lateral beam 22 are connected and engaged with each other, the mounting position of the pressing block 42 may be adjusted firstly. After the pressing block 42 is fixed, the bottom plate 30 and the skeleton boundary beam 21 are connected and fixed together.

Generally, the bottom plate 30 consists of multiple plates arranged laterally and the gap between two adjacent plates are sealed by a sealing rubber strip 33, as shown in FIG. 3.

In this solution, the bottom plate 30 consists of two plates. In this way, few plates needs to be connected and thus the sealing tightness of the bottom plate 30 can be ensured. Apparently, the bottom plate 30 consisting of more than two plates arranged laterally may also be feasible in an actual arrangement.

In a specific solution, the bottom plate 30 may be made of aluminium alloy extrusions. In this way, the bottom plate 30 has a smoother structure. Therefore, the bottom structure of the vehicle body is smooth and thus aerodynamics performance of the entire vehicle is improved.

Figure 5:
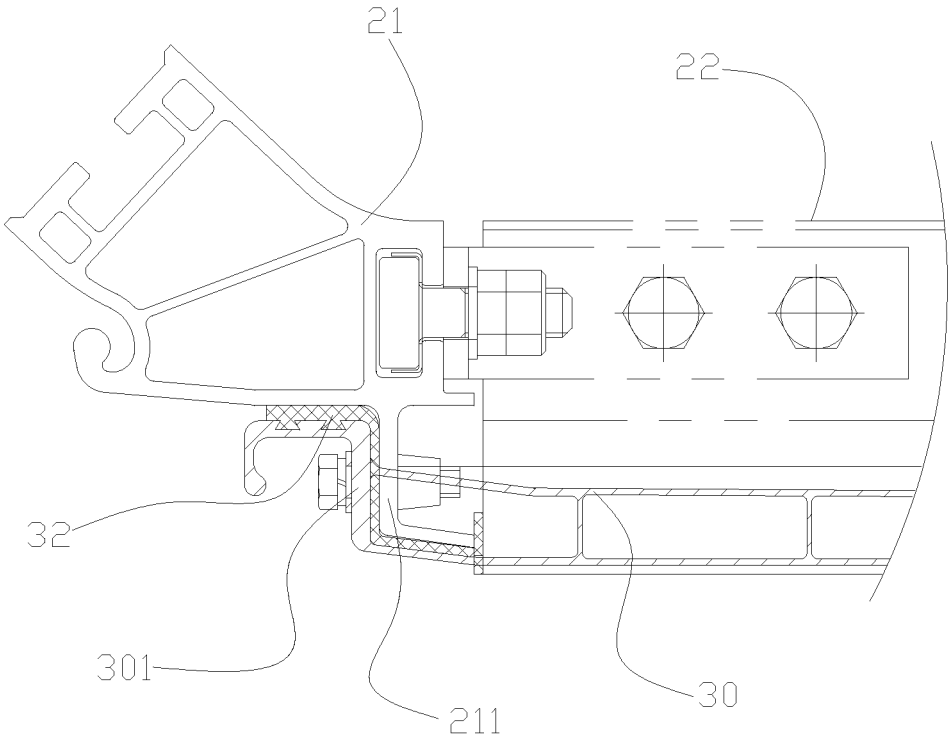
FIG. 5 is a partial enlarged view of part II shown in FIG. 2.

Referring to FIG. 5, FIG. 5 is a partial enlarged view of part II shown in FIG. 2.

The bottom plate 30 and the skeleton boundary beam 21 may be detachably connected by bolts. In this way, the connection is simple and reliable and the dismounting is convenient.

In a specific solution, the bottom plate 30 is provided with a flanging portion 301 at a side of the bottom plate 30 where the bottom plate 30 is connected to the skeleton boundary beam 21. This flanging portion 301 fits against an outer side of the side beam 211 of the skeleton boundary beam 21. The flanging portion 301 and the side beam 211 are connected by bolts.

In this case, the parts of the bottom plate 30 and the skeleton boundary beam 21 where the bottom plate 30 and the frame side beam 21 are connected fit against with each other, which avoids a slit forming at a place where the bottom plate 30 and the skeleton boundary beam 21 are connected, causing a poor sealing problem of the equipment compartment.

It may be understood that the flanging portion 301 of the bottom plate 30 fit against the inner side of side beam 211 of the skeleton boundary beam 21 may be also feasible if this is allowed by the structure. Similarly, the sealing of the equipment compartment can be ensured.

Herein, "outer side" refers to a side far away from the center of the vehicle body. Correspondingly, "inner side" refers to a side close to the center of the vehicle body.

To further improve the tightness of the bottom plate 30 and the skeleton boundary beam 21, a sealing piece 32 may be provided between the flanging portion 301 and the side beam 211.

The mounting structure for the equipment compartment bottom plate according to the present application is described in detail hereinbefore. The principle and the embodiments of the present application are illustrated herein by specific examples. The above description of examples is only intended to help the understanding of the method and the idea of the present application. It should be noted that, for those skilled in the art, a few of modifications and improvements may be made to the present application without departing from the principle of the present application, and these modifications and improvements are also deemed to fall into the scope of the present application defined by the claims.

The invention claimed is:

1. A mounting structure for an equipment compartment bottom plate, wherein the bottom plate is detachably connected to a skeleton boundary beam of the equipment compartment, a sliding rail is fixedly connected to a side of the bottom plate where the bottom plate is lap-jointed to a skeleton lateral beam of the equipment compartment, one of the sliding rail and the skeleton lateral beam is provided with a recess, and the other is provided with a protrusion engaged with the recess, the mounting structure for an equipment compartment bottom plate further comprises a pressing block assembly provided on the skeleton lateral beam in order to limit a position of the bottom plate in a vertical direction, wherein the pressing block assembly comprises a transition base and a pressing block, the transition base is fixedly connected to the skeleton lateral beam, and the pressing block is connected to the transition base and presses the sliding rail onto the skeleton lateral beam tightly.

2. The mounting structure for the equipment compartment bottom plate according to claim 1, wherein the transition base is provided with a mounting hole for assembling the pressing block, and the mounting hole is an elliptical hole extending in a direction in parallel with a length direction of a vehicle body.

3. The mounting structure for the equipment compartment bottom plate according to claim 1, wherein the pressing block is a wedge-shaped pressing block.

4. The mounting structure for the equipment compartment bottom plate according to claim 1, wherein the pressing block assembly is arranged at the middle of the skeleton lateral beam.

5. The mounting structure for the equipment compartment bottom plate according to claim 1, wherein the bottom plate is provided with a flanging portion at a side of the bottom plate where the bottom plate is connected to the skeleton boundary beam, the flanging portion fits against an outer side of a side beam of the skeleton boundary beam, and the flanging portion and the side beam are fixedly connected by a bolt.

6. The mounting structure for the equipment compartment bottom plate according to claim 5, wherein a sealing piece is further provided between the flanging portion and the side beam of the skeleton boundary beam.

7. The mounting structure for the equipment compartment bottom plate according to claim 1, wherein the sliding rail is fixed to the bottom plate by welding.

8. The mounting structure for the equipment compartment bottom plate according to claim 1, wherein the bottom plate is made of aluminium alloy extrusions.

9. The mounting structure for the equipment compartment bottom plate according to claim 1, wherein the pressing block assembly is arranged at the middle of the skeleton lateral beam.

10. The mounting structure for the equipment compartment bottom plate according to claim 2, wherein the pressing block assembly is arranged at the middle of the skeleton lateral beam.

11. The mounting structure for the equipment compartment bottom plate according to claim 3, wherein the pressing block assembly is arranged at the middle of the skeleton lateral beam.

* * * * *